United States Patent [19]

Scott et al.

[11] Patent Number: 4,833,863

[45] Date of Patent: May 30, 1989

[54] FIBROUS INSULATION BATT PACKAGING MACHINE

[75] Inventors: James W. Scott, Newark; Richard C. Yawberg, Grand Rapids, both of Ohio

[73] Assignee: Owens-Corning Fiberglas Corporation, Toledo, Ohio

[21] Appl. No.: 120,057

[22] Filed: Nov. 13, 1987

[51] Int. Cl.[4] ..... B65B 63/02; B65B 13/20

[52] U.S. Cl. ..... 53/438; 53/529; 53/258

[58] Field of Search ..... 53/529, 530, 570, 572, 53/438, 434, 512, 258

[56] References Cited

U.S. PATENT DOCUMENTS

| | | | |
|---|---|---|---|
| 3,065,586 | 11/1962 | Ghiringhelli | 53/529 |
| 3,327,449 | 6/1967 | Hullhorst et al. . | |
| 3,382,643 | 5/1968 | Hullhorst et al. | 53/529 X |
| 3,455,084 | 7/1969 | Broersma et al. | 53/529 |
| 3,458,966 | 8/1969 | Dunbar et al. . | |
| 3,481,268 | 12/1969 | Price et al. | 53/529 X |
| 3,499,261 | 3/1970 | Hullhorst et al. | 53/529 X |
| 3,696,583 | 10/1972 | Tezuka | 53/529 |
| 3,824,759 | 7/1974 | Finn et al. | 53/529 X |
| 3,971,191 | 7/1976 | Hoyland | 53/572 X |
| 4,099,363 | 7/1978 | Wistinghausen et al. | 53/529 |
| 4,241,562 | 12/1980 | Meyer | 53/529 X |
| 4,263,844 | 4/1981 | Hacking | 53/529 X |
| 4,640,082 | 2/1987 | Gill . | |

*Primary Examiner*—Horace M. Culver

*Attorney, Agent, or Firm*—Patrick P. Pacella; Ted C. Gillespie

[57] ABSTRACT

Apparatus for packaging fibrous insulation batts comprises means for compressing a stack of batts, a bagger for bagging the batts, and means for moving the stack of compressed batts into the bagger, where the bagger comprises upper and lower spouts which have a curvature approximating the curvature of the completed bag of batts.

3 Claims, 5 Drawing Sheets

FIBROUS INSULATION BATT PACKAGING MACHINE

TECHNICAL FIELD

This invention relates generally to machines for packaging fibrous batts of thermal insulation, and more particularly to such machines which use mechanical compression in conjunction with air evacuating means.

BACKGROUND ART

U.S. Pat. No. 3,327,449, issued to Hullhorst and Lockett on June 27, 1967, discloses a machine wherein a stack of batts is mechanically compressed and vacuum is applied by a vacuum shoe along a longitudinal edge portion of the compressed stack. A paper sheet is wrapped around the stack and the vacuum shoe and the edges of the sheet are glued together over the vacuum shoe.

U.S. Pat. No. 3,382,643, issued to Hullhorst on May 14, 1968, discloses apparatus wherein a sidewall vacuum plenum of a compression station is used to move a stack of batts into the compression station from a loading station. A pressure plenum forming a lower platen of the compression station aids movement of a compressed stack by a cross ram into a bag.

U.S. Pat. No. 3,458,966, issued to Dunbar and Hullhorst on Aug. 5, 1969, discloses a method of pneumatically compressing fibrous batts by enclosing a stack in a plastic bag and evacuating air out of the bag endwise. A restraining sleeve is slipped over the bag and stack after they are compressed by ambient air pressure.

U.S. Pat. No. 3,499,261, issued to Hullhorst, Brown, and Mosier on Mar. 10, 1970, discloses three embodiments of packaging apparatus. FIGS. 1 and 2 disclose an open-top chamber into which a wrapping sheet and a stack of batts are placed. Endwall vacuum plenums evacuate air endwise out of the batts. A bottom wall pressure plenum ejects a wrapped stack. FIGS. 3 and 4 disclose means for compressing a stack of batts horizontally while a bottom wall vacuum plenum evacuates air transversely of the batts parallel to their major surfaces. FIGS. 5–10 disclose the apparatus of U.S. Pat. No. 3,382,643 mentioned above.

U.S. Pat. No. 3,824,759, issued to Finn and Smith on July 23, 1974, discloses apparatus wherein stacks of batts are partially compressed between sets of fingers at a loading station and then moved to a compression station having a sidewall vacuum plenum for holding the partially compressed stacks in the compression station while the loading fingers are withdrawn.

DISCLOSURE OF THE INVENTION

In accordance with the invention, a fibrous batt packaging machine is disclosed wherein pneumatic compression of a stack of fibrous batts is accomplished first by air pressure acting on the stack perpendicularly to the major surfaces of the batts, followed by mechanical compression in the same orientation but in the opposite direction. A bagging spout with contoured upper and lower arms is shaped to confine a compressed stack of batts to substantially the same rounded shape the stack naturally assumes in a finished package. This avoids overcompression of the batts, which degrades product properties.

BRIEF DESCRIPTION OF THE DRAWINGS

The invention is hereinafter more fully explained, reference being had to the accompanying drawings wherein.

BEST MODE OF CARRYING OUT THE INVENTION

Figure 1:
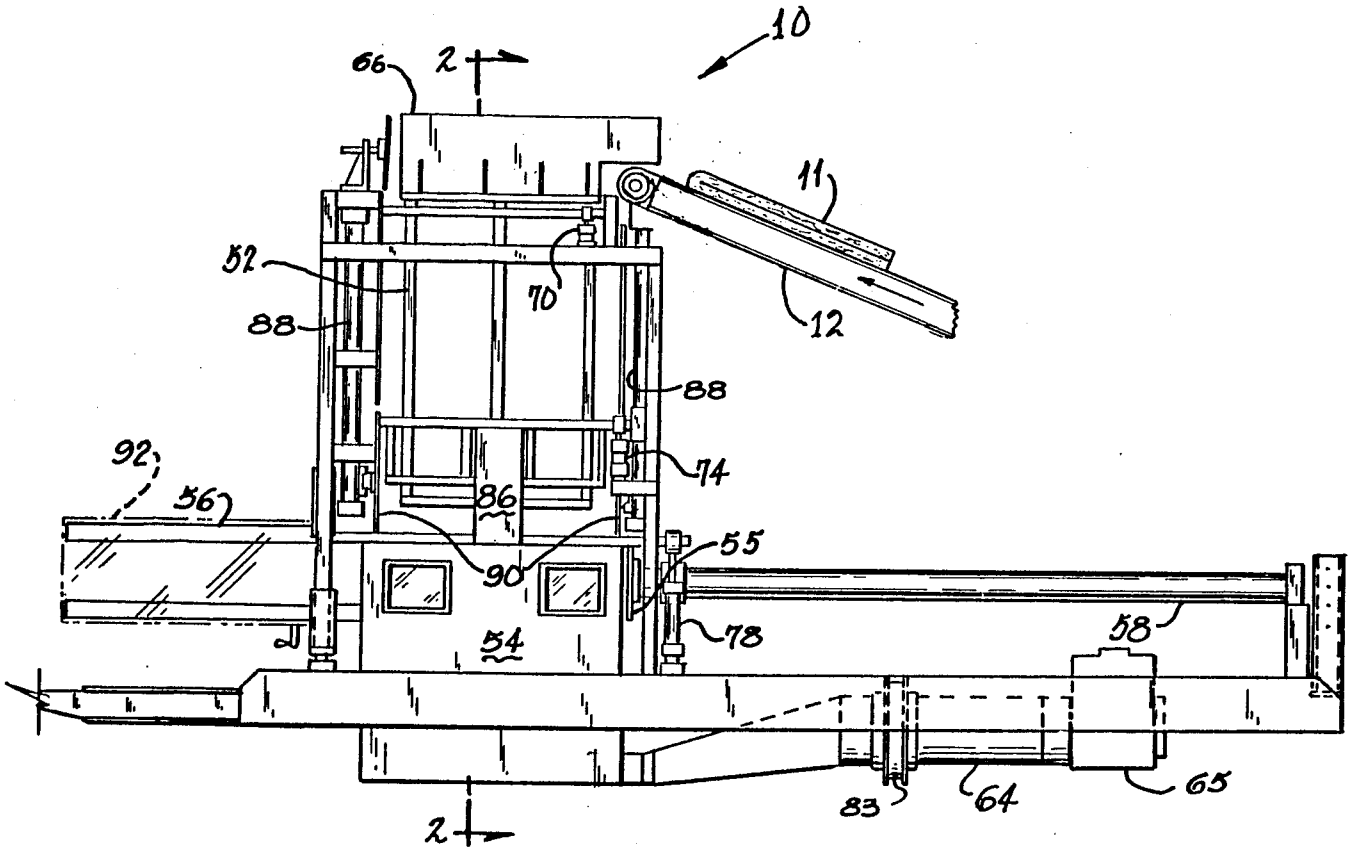
FIG. 1 is a schematic side elevational view of a fibrous insulation batt packaging machine constructed in accordance with the invention.

With reference to the drawings, FIG. 1 shows a packaging machine 10 constructed in accordance with the invention and including an inclined infeed conveyor 12 for delivering fibrous batts 11, for example, from a glass fiber batt forming machine (not shown). The batts can be folded, as shown, or unfolded.

Figure 2A:
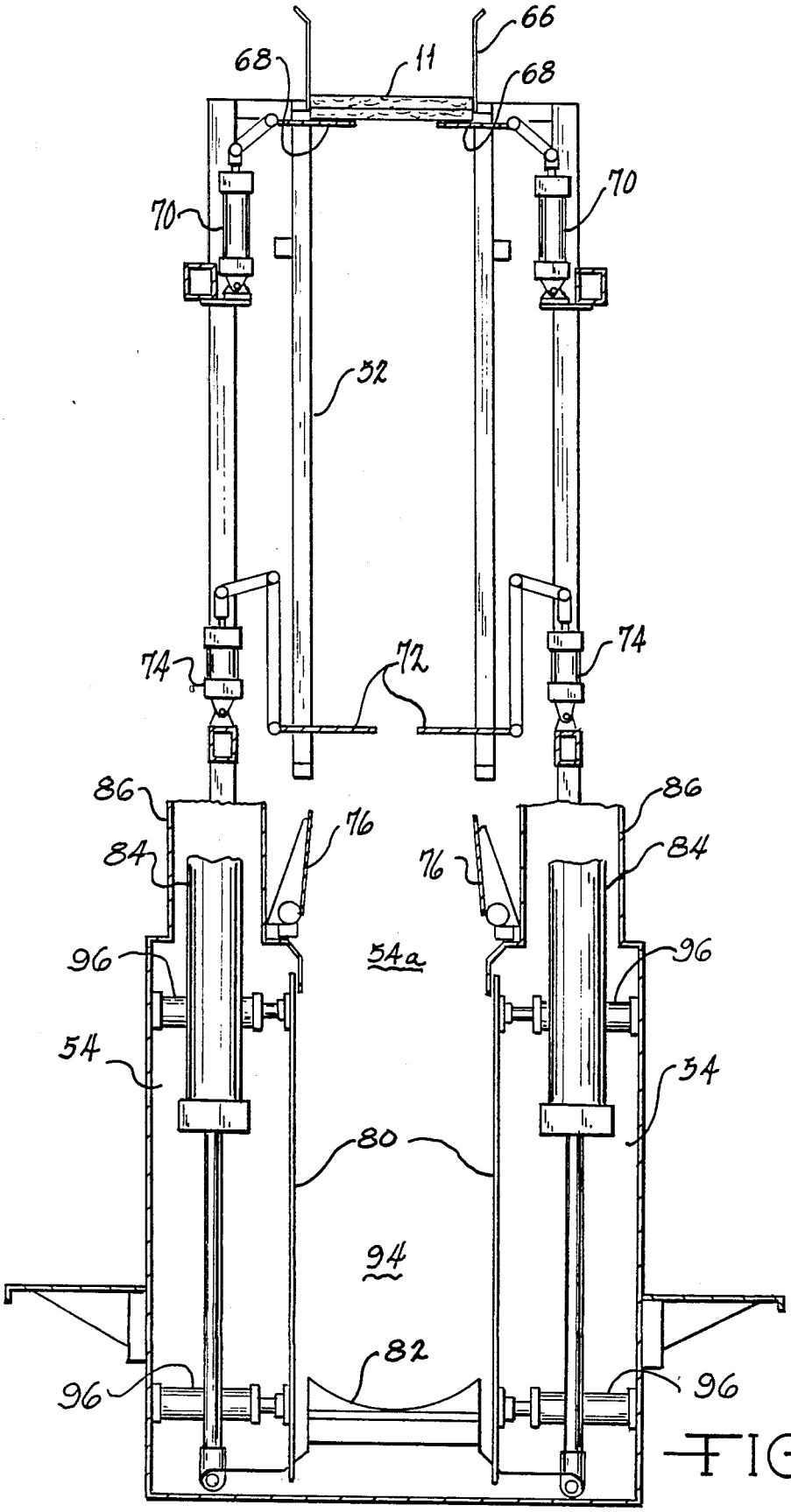
FIGS. 2A, 2B and 2C are vertical sectional views taken generally along the line 2—2 of FIG. 1 and showing various steps in the packaging operation.
Figure 2B:
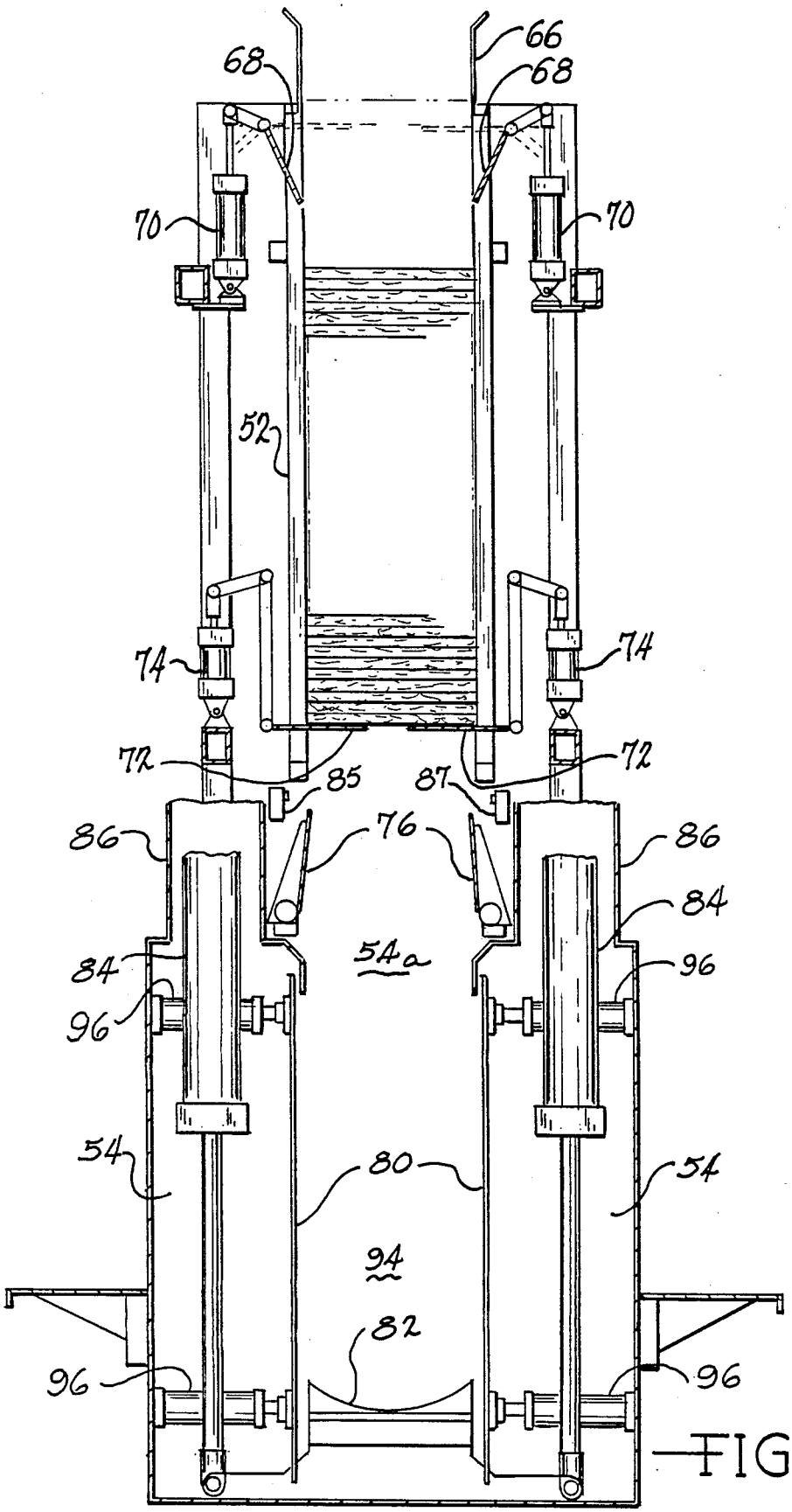
Figure 2C:
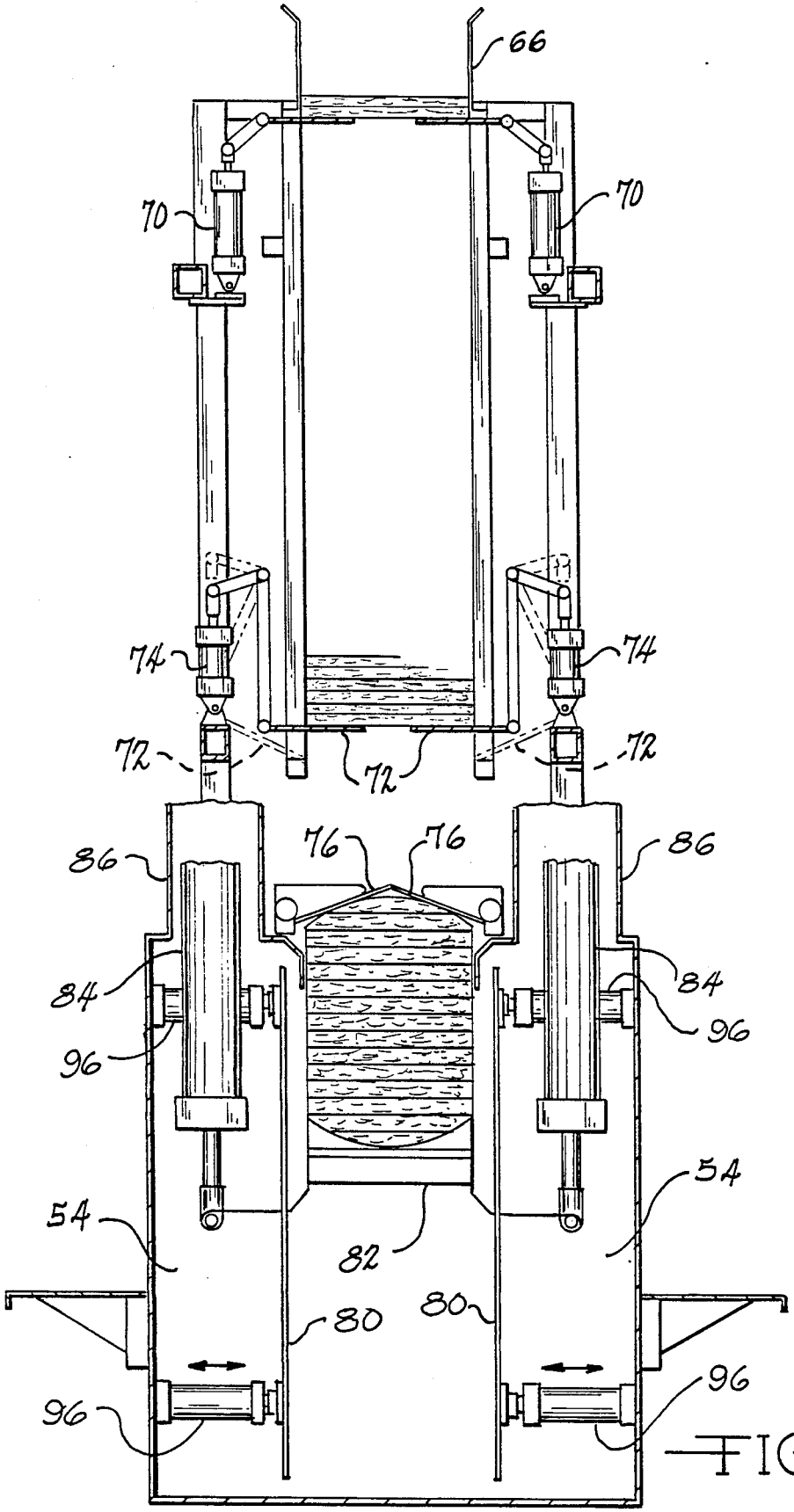
Figure 3:
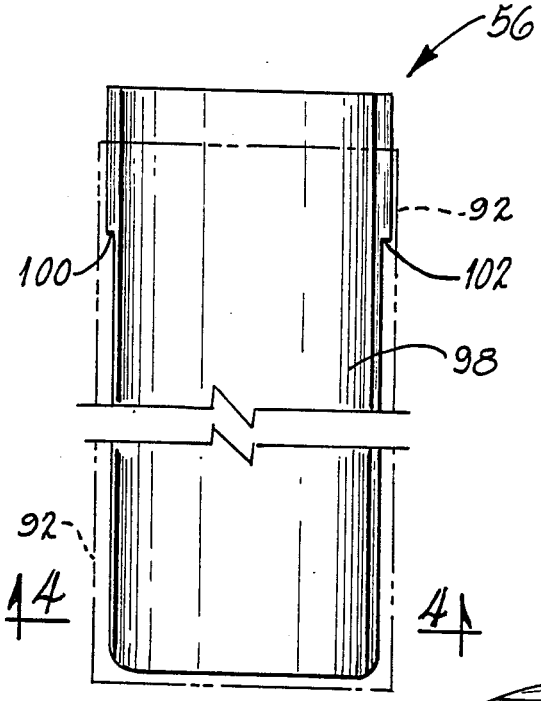
FIG. 3 is a top plan view of a bagger of the packaging machine of the invention, showing a bag in broken lines.
Figure 4:
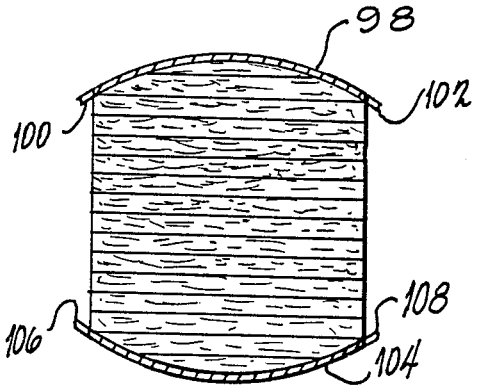
FIG. 4 is a front end view of the bagging spouts taken generally along the line 4—4 of FIG. 3.

The batts are fed by the infeed conveyor into a stacking framework 52, dropped into a vacuum chamber 54 wherein they are pneumatically and mechanically compressed, and pushed out of the vacuum chamber by a reciprocally mounted pushing plate 55 as a compressed stack into the bagging apparatus 56. The pushing plate 55 is reciprocated by any suitable pushing means, such as pneumatic actuator 58. The vacuum chamber is connected to a duct 64 to which a vacuum pump 65 may be suitably connected. Details of the stacking framework 52 and the vacuum chamber are best shown in FIGS. 2A, 2B and 2C, while details of the bagging apparatus are best shown in FIGS. 3 and 4. With reference to FIG. 2A, the batts are fed successively into a three-sided infeed chamber 66 above the stacking framework 52 where they come to rest initially on a pair of oppositely disposed pivotally mounted upper gate members 68 operatively connected respectively to a pair of pneumatic actuators 70 pivotally mounted on suitable framework adjacent their lower ends. As shown in FIG. 2B, operation of the actuators 70 pivots the gate members 68 downwardly, causing a batt thereon to fall into the stacking framework 52, whereby, after several cycles of the gates 68, a stack of batts is formed on top of a pair of oppositely disposed pivotally mounted lower gate members 72 operatively connected respectively to a pair of pneumatic actuators 74 pivotally mounted on suitable framework adjacent their lower ends.

The machine 10 can be programmed to operate in different manners, depending on the thickness of the batts, whether or not they are folded, and the number to be packaged in each bag. In one example, after a predetermined number of batts has accumulated in a first stack of, for example five batts, resting on the lower gate members 72, the actuators 74 are extended to move the lower gate members 72 to the broken-line positions thereof shown in FIG. 2C, thereby allowing the first stack of five batts to fall into the vacuum chamber. The actuators 74 are then returned to move the lower gate members 72 back into position for accumulation of a second stack of batts thereon.

The vacuum chamber has an opening 54*a* at the top for receiving stacks of batts, the opening 54*a* being closable by a pair of opposed pivotally mounted chamber top doors 76 each operatively connected to a pneumatic actuator 78, one of which is shown in FIG. 1. When the first stack of batts falls into the vacuum chamber, the chamber top doors 76 are open, as shown in FIG. 2A.

Inside the vacuum chamber are a pair of sidewalls, which are preferably perforated, such as side grills 80, for maintaining batts in alignment while allowing air to be withdrawn therefrom. Also in the vacuum chamber is a platen 82 mounted for vertical movement. Preferably, the platen is shaped with an upwardly concave surface corresponding with the ultimate shape of the bag of batts. Also, the lower surfaces of the closed chamber top doors should approximate the profile of the finished bag of batts. This can be accomplished either by making the lower surface of the chamber top doors with the exact same contour of the bag of batts, or by providing a slanted straightline surface, as shown in FIG. 2B, which is tangent to the profile of the finished bag of batts. As a result, a stack of compressed batts is compressed substantially only the minimum amount required to package it in a bag. Any suitable means, such as a pair of pneumatic platen actuators 84 fragmentarily shown in FIGS. 2A, 2B and 2C can be used to raise and lower the platen. Preferably, each of the platen actuators is covered by a shroud 86, one of which is shown in FIG. 1.

When the first stack of batts drops into the vacuum chamber, the platen actuators 84 are extended to lower the platen to the broken-line position shown in FIGS. 2A and 2B. A low vacuum is applied to the first stack of batts. The lower gate actuators 74 are then extended and returned again to allow a predetermined number of batts accumulated in a second stack to fall into the vacuum chamber and to allow accumulation of a third stack of batts on the lower gate members 72.

After the second stack of batts falls into the vacuum chamber, an increased vacuum determined by the count of batts is applied to the vacuum chamber. The vacuum pump can be adapted to run continuously, but the amount of vacuum applied to the vacuum chamber is controlled by any suitable means, such as butterfly valve 83 in the duct 64 (FIG. 1).

The lower gate actuators 74 are then extended and returned a third time to allow a predetermined number of batts accumulated in a third stack to fall into the vacuum chamber and to allow accumulation of still another stack of batts on the lower gate members. After the third stack and any subsequent stacks enter the vacuum chamber, the amount of vacuum applied to the vacuum chamber is shifted to a high value determined by the count of the batts.

The vacuum chamber is adapted with means for determining whether or not the batts have moved far enough downward to clear the chamber opening 54*a*. A preferred means is light source 85 (shown in FIG. 2B only) provided at the top of the vacuum chamber, and a corresponding receiver, such as photoelectric cell 87 on the opposite side of the chamber. When the third or final stack is released from the stacking framework and drops toward the vacuum chamber, the light beam falling on the cell is broken, causing the amount of vacuum applied to the vacuum chamber to be further increased to a high value, by full opening of the butterfly valve in the duct 64 (FIG. 1). This causes the batts to be pneumatically compressed by atmospheric pressure at the top of the final stack, until the light beam on the photoelectric cell is restored, whereupon the actuators 78 are extended to close the chamber top doors 76 and the vacuum applied to the vacuum chamber is shut off by the closing of the butterfly valve.

The platen actuators are then retracted to raise the platen from the broken-line position shown in FIGS. 2A and 2B to the full-line position shown in FIG. 2C, further compressing the batts mechanically against the closed chamber top doors. At the same time, vacuum chamber end gates 90 are raised by any suitable means, such as two pneumatic actuators 88 as shown FIG. 1. In their lower positions (not shown) the endgates close an outlet opening from the vacuum chamber to the bagging apparatus 56, and also close the inlet opening from the vacuum chamber to the pushing plate 55.

After the end gates are raised, actuator 58, is extended first to push the compressed stack of batts into a bag 92 on the bagger 56 and then to push the bagged batts and the bag off the bagger. Subsequently, actuator 58 is retracted. The actuators 88 are then operated to lower the end gates 90, the actuators 78 are retracted to open the chamber top doors, the actuators 84 are extended to lower the platen to the full-line position shown in FIGS. 2A and 2B, and a new bag is placed on the bagger for the beginning of a new cycle.

The open chamber top doors, the portions of the end gates 90 vertically commensurate therewith, and the side grills 80 form inlet tube 94 for the batts. The stacking framework 52 and the inlet tube are vertically mounted in line so that once the batts reach the infeed chamber, they are moved only vertically during the entire compression process and are not moved horizontally until after the final compression of the batts prior to bagging. When a batt is in the inlet tube, the batt occupies substantially the full cross-sectional area of the inlet tube, whereby maximum use is made of the pressure differential for compressing the batt.

After all the batts have been placed in the inlet tube, and prior to the final compression step by the platen, the side grills 80 can be moved a short distance away from the pack by any suitable means such as hydraulic actuators 96. This will reduce the contact between the side grills and the paper flanges on the insulation batts.

FIG. 3 shows the upper spout 98 of the bagger and a bag mounted thereon. The upper spout is provided with laterally extending lip portions 100 and 102 which aid in tightening the mouth of the bag on the spouts when the upper spout is raised. The lower spout 104 (not shown in FIG. 3) is similarly constructed. The upper bagging spout preferably is vertically adjustable by suitable means to aid in installation of a bag on the spouts.

FIG. 4 shows the transverse profiles of the upper and lower spouts 98 and 104, respectively. These profiles are designed to correspond with the shape of a compressed stack of batts that the stack naturally assumes after packaging in a bag. As shown, the lower surface of the upper spout and the upper surface of the lower spout, which are the surfaces that actually contact the batts, have the same transverse profile as that of a completed bag. Preferably, the upper surface of the platen corresponds with the profile of the lower spout. As shown, the lower spout 104 has laterally extending lip portions 106 and 108 which also aid in tightening the mouth of the bag on the spouts. Preferably, the upper and lower spouts are not connected to each other and there are no sides to the chute formed by the spouts. This feature, along with the laterally extending lip portions 100, 102, 106 and 108, facilitate the raming of the compressed insulation batts into the bag with the minimal tearing or disturbance of the paper flanges on the sides of the batts.

Figure 5:
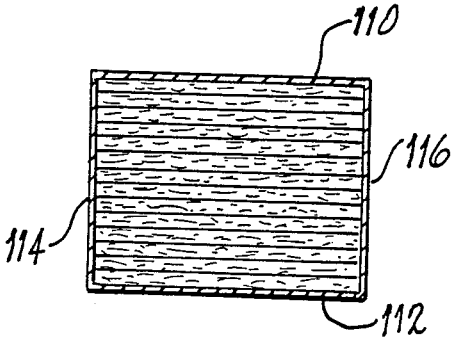
FIG. 5 (PRIOR ART)
FIG. 5 is, a view similar to FIG. 4, but schematically showing bagging spouts of the prior art.

FIG. 5 represents the transverse profiles of bagging spouts 110 and 112 of the prior art, on the same scale relative to that of FIG. 4, and illustrates the amount that a stack of the same number of batts of the same thickness as in FIG. 4 is compressed before bagging in a prior art bagger. Although the finished bags of this invention and of the prior art both end up in the same final size and shape, the compressed stack of a prior art bag has been overcompressed before bagging, resulting in damage to the bonds between fibers and a lower recovery of the batts toward their original thickness after the package is opened by the customer. Also, prior art baggers are adapted with sidewalls 114 and 116 which can damage the paper flanges on the edges of the batts.

Figure 6:
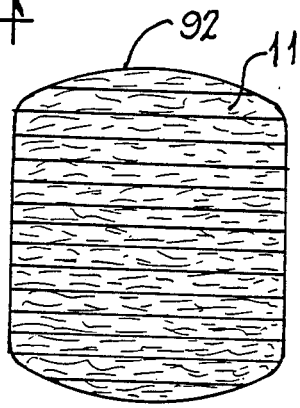
FIG. 6 is a schematic cross-sectional view of a bag of batts.

FIG. 6 shows the cross-sectional view of a bag of batts after the batts have been packaged. As can be seen the spouts 98 and 104 have the same curvature or shape as the bag of batts.

Various modifications may be made in the structure shown and described without departing from the scope of the invention as set forth in the following claims.

We claim:

1. Apparatus for packaging fibrous insulation batts comprising means for compressing a stack of batts into a stack of batts having a curved transverse profile, when viewed in the cross-section, which a bag of batts naturally assumes in a finished package, a bagger for applying a bag around the batts, and means for moving the compressed batts into the bagger, where said means for compressing, said means for moving, and said bagger are all adapted to maintain the transverse profile of the stack of batts constant as the stack of batts is moved from the means for compressing into the bagger, where the bagger comprises an upper spout and a lower spout, and where the surfaces of the upper and lower spouts contacting the batts are curved with a curvature approximating the curvature of the bag of batts upon completion of the bagging to maintain the transverse profile of the stack of batts at a constant.

2. The apparatus of claim 1 in which the bagger has no sidewalls, and the upper and lower spouts are spaced apart from each other.

3. A method for packaging fibrous insulation batts comprising positioning batts into a stack, compressing the batts into a stack of batts having a curved transverse profile, when viewed in the cross-section, which a bag of batts naturally assumes in a finished package, moving the compressed batts into a bagger while maintaining the transverse profile of the stack of batts constant, applying a bag around the compressed stack of batts, and removing the stack of batts and bag from the bagger to form a bag of batts with the same curved transversed profile when viewed in the cross section.

* * * * *